US005908037A

United States Patent [19]

Pierson

[11] Patent Number: 5,908,037

[45] Date of Patent: Jun. 1, 1999

[54] COMPACT WITH HERMETIC SEALING ASSEMBLY

[75] Inventor: Theodore J. Pierson, Kinnelon, N.J.

[73] Assignee: Pierson Industries, Denville, N.J.

[21] Appl. No.: 08/964,270

[22] Filed: Nov. 4, 1997

[51] Int. Cl.[6] ..... A45D 33/00

[52] U.S. Cl. ..... 132/293; 132/304; 132/305

[58] Field of Search ..... 132/293, 298, 132/301, 303, 304, 305, 299; 206/235, 823; 220/324, 326, 344

[56] References Cited

U.S. PATENT DOCUMENTS

| | | | |
|---|---|---|---|
| 1,664,301 | 3/1928 | Kendall | 132/299 |
| 1,672,417 | 6/1928 | Leberman | 220/324 |
| 1,818,409 | 8/1931 | Leberman | 132/301 |
| 1,874,433 | 8/1932 | Briggs | 132/303 |
| 2,033,295 | 3/1936 | Parkin | 220/344 |
| 2,054,004 | 9/1936 | Sandberg . | |
| 2,315,647 | 4/1943 | Nyden | 132/305 |
| 2,399,997 | 5/1946 | Flaster | 132/300 |
| 2,424,817 | 7/1947 | Grassi | 132/305 |
| 2,449,196 | 9/1948 | Bent . | |
| 2,737,189 | 3/1956 | Morningstar et al. | 132/305 |
| 2,746,462 | 5/1956 | Kasdan . | |
| 4,454,889 | 6/1984 | Contreras, Sr. | 220/344 |
| 4,586,519 | 5/1986 | Seidler et al. | 132/293 |
| 4,781,288 | 11/1988 | Wing . | |
| 4,815,608 | 3/1989 | Silberberg . | |
| 5,107,871 | 4/1992 | Butcher et al. . | |
| 5,135,012 | 8/1992 | Kamen et al. . | |
| 5,323,794 | 6/1994 | Favre . | |
| 5,353,818 | 10/1994 | Suzuki et al. . | |

FOREIGN PATENT DOCUMENTS

| | | | |
|---|---|---|---|
| 142306 | 6/1951 | Australia | 220/326 |
| 0 385 837 A1 | 2/1990 | European Pat. Off. . | |
| 0 562 965 A1 | 3/1993 | European Pat. Off. . | |
| 0 580 512 A1 | 7/1993 | European Pat. Off. . | |
| 2558045 | 6/1984 | France | 132/314 |
| 2691339 | 12/1993 | France | 132/293 |

*Primary Examiner*—Todd E. Mamahan
*Assistant Examiner*—Eduardo C. Robert
*Attorney, Agent, or Firm*—Lerner, David, Littenberg, Krumholz & Mentlik, LLP

[57] ABSTRACT

The invention is a hermetically sealed compact. The compact has a base with a compartment having an open end and a cover pivotably connected to the base so that the cover is movable from an open position to a closed position with respect to the base. A tray is slidably disposed within the compartment in the base for limited vertical movement and the tray has a peripheral wall with an upper sized and shaped top surface. An operatively associated seal assembly between the cover and the base includes a sealing member such as a sized and shaped gasket is provided to match and mate with the upper sized and shaped top surface of the peripheral wall of the tray to form a hermetic seal therewith when the cover is moved to the closed position. A latch assembly is provided to releasably secure the cover to the base and to move the sealing assembly to form the hermetic seal. The tray coacts with a resilient member within the compartment for normally urging the tray upwardly to maintain the hermetic seal when the cover is in the closed position. The latch assembly include protrusions and coacting caming members operative to break the hermetic seal and to enable the cover to move to the open position.

19 Claims, 6 Drawing Sheets

COMPACT WITH HERMETIC SEALING ASSEMBLY

BACKGROUND OF THE INVENTION

1. Field of the Invention

This invention relates generally to containers with hermetic seals and more particularly to a compact for holding, retaining and hermetically sealing spoilable cosmetics, make-up and the like pastes, powders and granular materials therein when the compact is in the closed position which includes, an improved seal assembly for establishing the airtight environment for such materials, and a latch assembly for coacting with the seal assembly and for opening and closing the compact, so operatively connected in the compact as to break the hermetic seal during opening of the compact.

2. Description of the Prior Art

The broad concept of a hermetically sealed compact is known in the art. Additionally, it is known in the art to provide a hermetically sealed compact having a spring arrangement beneath a tray within the base for the compact which acts to bias the tray upwardly against the inner surface of the cover of the compact when the cover is in the closed position, and a latch for releasably securing the cover to the base and for maintaining the cover in the closed position. It is also known that an airtight environment can be established by forcing a relatively soft substance such as a rubber O-ring against a hard surface.

These features are shown in various patents such as U.S. Pat. Nos. 2,054,004 and 4,781,288 and European Patent Publication No. 562,965 A1.

Thus, in Pat. No. '004, a vanity case is disclosed for preventing powder contained therein from escaping. The vanity case illustrated has a casing assembly defining a compartment and a coacting cover pivotably connected to the casing, a receptacle for the powder is slidably mounted for limited floating movement in the compartment formed in the casing. The receptacle has a peripheral wall, the upper surface of which is urged into sealing engagement with the inner face of the cover by a resilient member which coacts with the tray to move it upward as the cover is pivoted to the closed position. The compact may have a sealing gasket between the inner face of the cover and the upper face of the peripheral wall of the tray to form a substantially airtight seal to prevent powder escaping from the receptacle when the vanity case is in the closed position. A conventional latch assembly releases and secures the cover from the open to the closed position and coacts with and helps maintain the airtight seal.

In Pat. No. '288 a container having a base and a coacting cover is illustrated for retaining and hermetically sealing condoms using a resilient O-ring disposed in an annular groove in the upper or top surface of the perimeter of the base which coacts with the inner surface of the cover when the cover is in the closed position. A conventional latch acts to release and secure the cover so it can move from the open to the closed position.

European Patent Publication No. 562,965 A1 discloses a hermetically sealed compact having a base defining a compartment having an open end for cosmetics and make-up, an annular perimeter formed by the base about the compartment having an upper surface, and a coacting cover having an annular elastic assembly affixed to the inner surface of the cover. The hermetic seal is created when the cover is moved to the closed position whereby the annular elastic assembly is urged into sealing engagement with the upper surface of the annular perimeter on the base.

None of the prior art patents provide adequately secure and durable sealing means nor do they show a resilient assembly on the inner face of the cover for mating engagement with the upper face of the perimeter of a slidable tray in the base of the compact shown when the cover is in the closed position. The hermetically sealed compact in accordance with the present invention has a sealing assembly which is established by sealing elements on the operatively associated inner face of the cover and the upper face of the peripheral wall of a slidable tray in the base for the compact, which sealing assembly and upper face of the peripheral wall are precisely sized and shaped for interengagement and mating relation.

The present invention also provides an improved latch assembly which acts to maintain the hermetic seal formed by the sealing assembly and upper face of the peripheral wall and operates to break the hermetic seal formed by the sealing assembly when the latch is moved to enable the cover to pivot from the closed to the open position.

SUMMARY AND OBJECTS OF THE INVENTION

Thus, the present invention covers an improved hermetically sealed compact for holding, retaining and maintaining spoilable cosmetics, make-up and the like paste, powder and granular materials under generally airtight conditions when the compact is in the closed position, having a base with an annular wall defining a compartment open at one end in which a tray for holding the cosmetics, make-up and other like materials is slidably mounted for limited vertical movement, the tray having a peripheral wall with a sized and shaped upper surface, a cover having an inner surface is connected to the base so that the cover can pivot from an open position to a closed position so as to overlie the tray, a seal assembly is provided having seal means with an annular groove to form a hermetic seal between the inner surface of the cover and the upper surface of the peripheral wall on the tray when the cover is moved to the closed position, biasing spring means in the compartment in the base is disposed for operative interrelation with the tray to continuously urge the tray into engagement with the seal means when the cover is pivoted to the closed position, and a latch assembly connected in the base is movable to lock the cover in the closed position and to release the cover for movement to the open position.

The present invention further covers a hermetically sealed compact as above described wherein the base has a cutaway section formed in the annular wall and a caming means therein, and the latch assembly is mounted in the base and includes, a slidable locking plate with a finger gripping member extending through the cutaway section to the exterior of the compact to enable the latch assembly to be manually moved from a first position to lock the cover when it is pivoted to the closed position and to a second position to release the cover to enable it to move from the closed position to the open position, said locking plate disposed for interaction with the caming means in the base, when releasing the cover from the closed position, and means on the locking plate operative to engage and break the hermetic seal formed by the seal means during interaction with the caming means.

The present invention also covers a hermetically sealed compact as above described wherein the cover has a hook-shaped latch, the latch assembly has a keeper formed in the locking plate, the hook-shaped latch on the cover extends downwardly and is disposed to engage the keeper on the locking plate when the cover is moved to the closed position to maintain the cover in the closed position, and said hook-shaped latch operable to disengage the keeper when the locking plate is moved to release the cover to enable the cover to coact with the means on the locking plate for breaking the hermetic seal and to move to the open position.

The present invention also covers the improved latching means as above described for breaking hermetic seals formed in compacts, containers and the like.

Accordingly, one aspect of the present invention is to provide a hermetically sealed compact for retaining cosmetics, make-up and the like paste, powder and granular materials under substantially airtight conditions to maintain and insure that the cosmetics, make-up and other like materials are fresh and in usable condition and to prevent them from escaping from the compact.

It is one of the primary aspects of this invention to provide a hermetically sealed compact with a generally resilient sealing means having an annular groove precisely shaped and sized and disposed when the cover of the compact is moved to the closing position to receive the upper shaped and sized surface of the peripheral wall for the tray, for greater and improved contact between the annular groove in the sealing means and the upper surface of the peripheral wall, for establishing a superior airtight seal for the contents and materials held in the tray of the compact.

Another aspect of the invention as above described is to provide in a compact a hermetic seal formed by an annular groove and a mating annulus with which a number of sealing means can be used, such as a gasket arranged on the inner surface of the cover, or a gasket arranged on or with the mating annulus on a tray for cosmetics, make-up and the like pastes, powders and granular materials or wherein the tray is fabricated from a resilient material to avoid the necessity of a gasket to establish an effective airtight seal for the materials or contents in the tray.

It is another aspect of the invention to provide sealing means which can accommodate a mirror on the inner surface of the cover and wherein the compact can be fabricated in a number of shapes.

A further aspect of the present invention is to provide latch means which maintain the inner surface of the cover in its closed position against the upper surface of the peripheral wall of the tray, and for compressing a biasing spring so that it will exert additional forces urging the tray upwardly to maintain the hermetic seal when the cover is in the closed position.

A still further aspect of the invention is to provide a latch assembly disposed to coact with caming means in the base which includes at least two upwardly extending protrusions or prongs for contacting the inner surface of the cover, the coaction with the caming means enables the upwardly extending protrusions to translate the horizontal movement of the latch assembly to a vertical opening force to break the hermetic seal formed by the sealing means and to enable the cover to move to open position.

It is yet another aspect of the invention to use the caming action with the latch assembly so that when the cover contacts the protrusions on the latch means as it is moved to the closed position, that the downward movement of the cover causes the latch assembly to slide horizontally to its closed position, and to enable the keeper on the locking plate of the latch assembly to engage a hook-shaped latch on the cover to lock the cover in the closed position.

DESCRIPTION OF PREFERRED EMBODIMENTS

Figure 1:
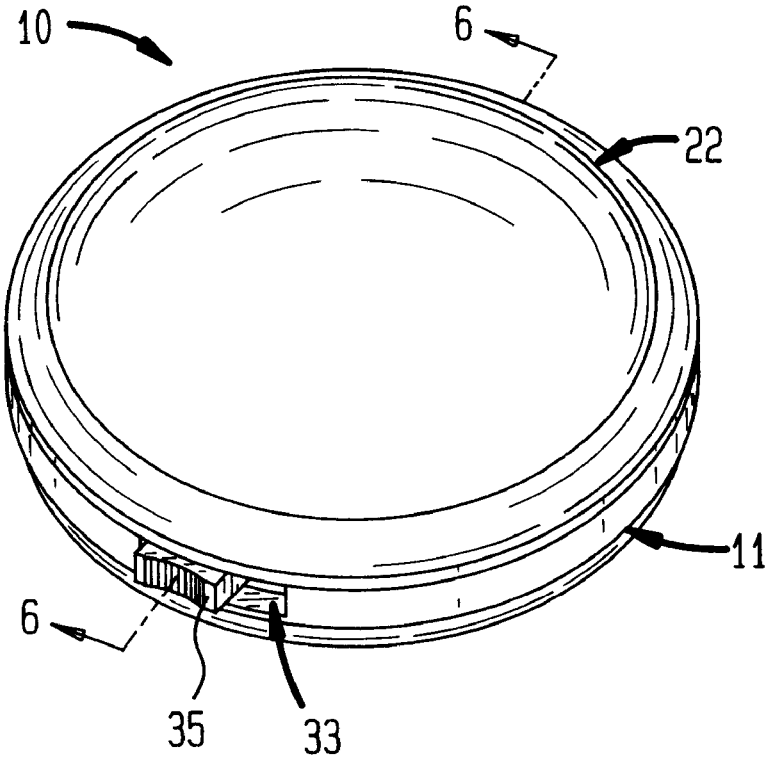
FIG. 1 is a top perspective plan view of one preferred embodiment of a hermetically sealed compact in accordance with the invention showing the cover in its closed position.
Figure 2:
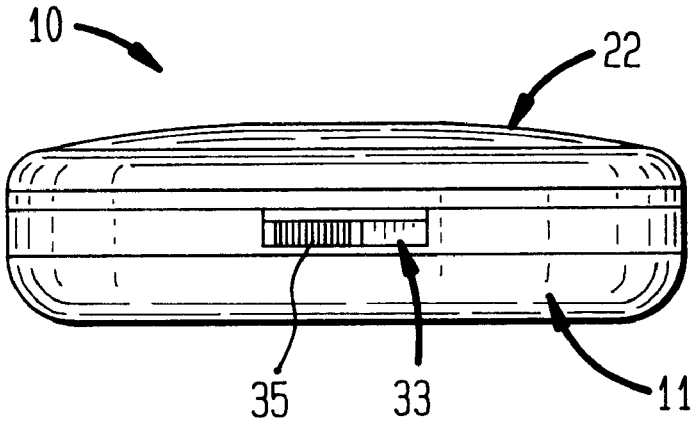
FIG. 2 is a front view of the form of the invention shown in FIG. 1.
Figure 3:
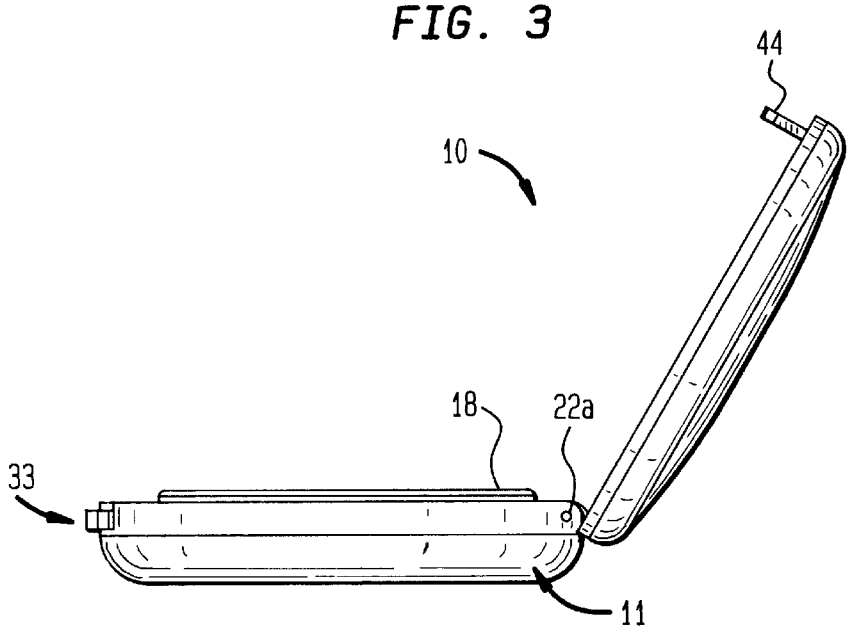
FIG. 3 is a side elevation view of the form of the invention shown in FIGS. 1 and 2, showing the cover in its open position.
Figure 4:
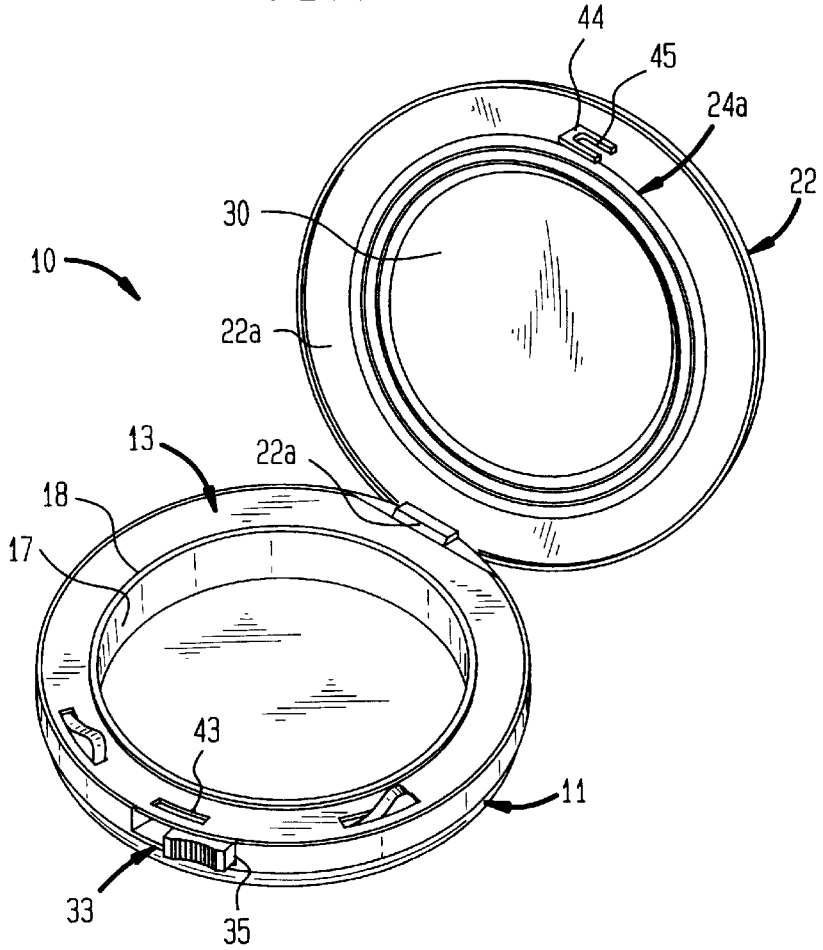
FIG. 4 is a top perspective view of the form of the invention shown in FIGS. 1, 2 and 3 also showing the cover in its open position.

Referring to drawings FIGS. 1 through 13, show one preferred embodiment of a hermetically sealed compact 10 in accordance with the present invention having a generally round shape and made from any suitable polypropylene or other plastic or resin material which can be easily formed, cast, shaped or fabricated at a relatively low cost. Those skilled in the art will readily recognize that handheld compacts are well known in the commercial marketplace and have many shapes and sizes and can be cast, molded or otherwise fabricated of any of these materials.

Compact 10 has a base 11 with an annular wall 12 and a first or lower bezel 13 affixed to the upper end of the annular wall 12 to define with the annular wall a compartment 14.

Lower bezel 13 has an annular horizontal section 13*a* and inwardly of the annular wall 12 an annular vertical section which forms a predetermined sized opening as at 15 extending therethrough for communicating with the compartment 14. A tray member 16 for holding the cosmetics, make-up and the like materials is slidably mounted in opening 15 for limited vertical movement.

Tray member 16 has a peripheral wall 17 and will be formed with a circular or other shape to fit the sized and shaped opening 15 formed by the annular vertical section 13*a* on the lower bezel 13. Tray member 16 is also provided with a peripheral wall 17 with an upper surface as at 18 and will be sized to form a storage compartment 19 adequate to receive the cosmetics, make-up and the like materials to be stored in compact.

Figure 5:
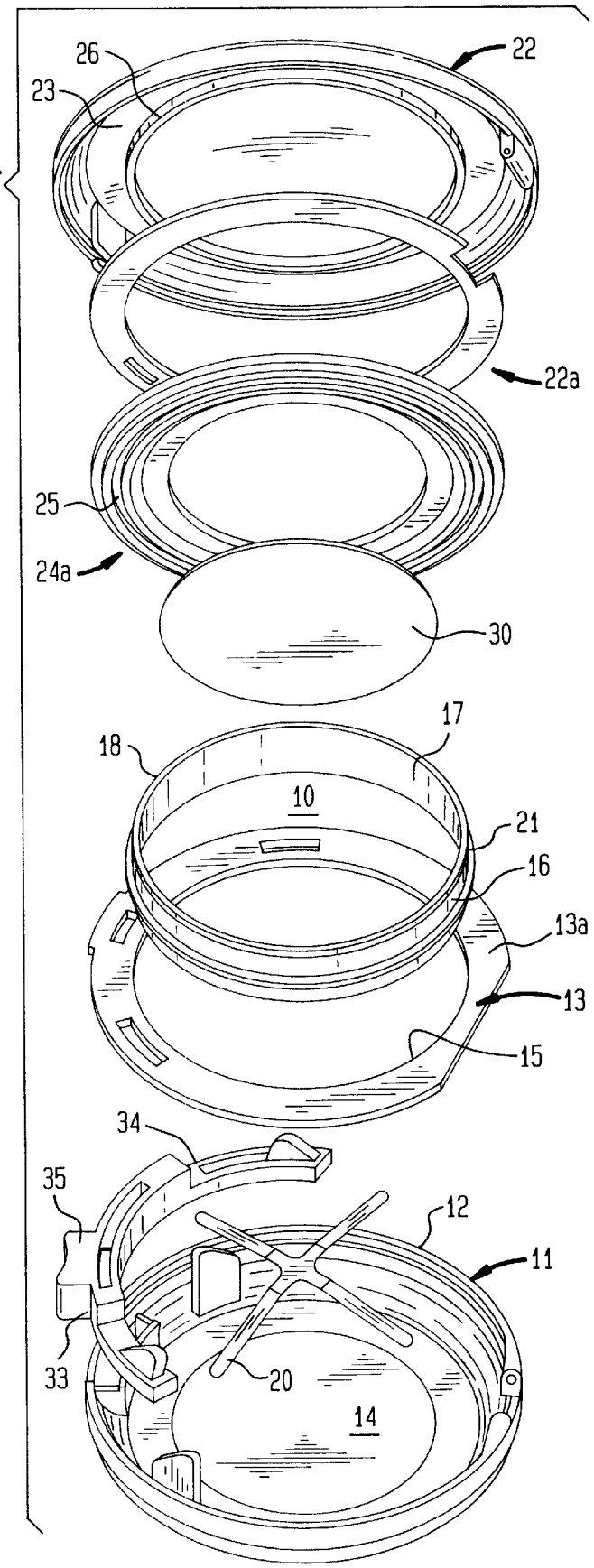
FIG. 5 is an exploded perspective view of the form of the invention shown in FIGS. 1, 2, 3 and 4.
Figure 6:
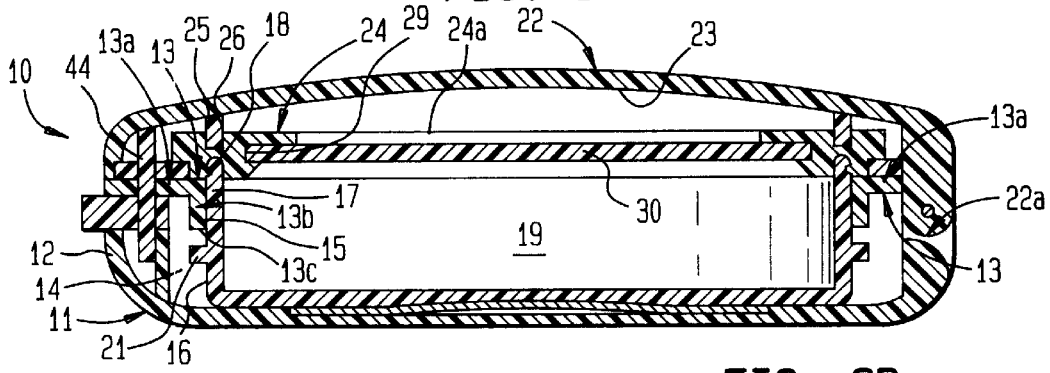
FIG. 6 is a cross-section taken on line 6—6 of FIG. 1, showing the seal assembly for the form of the invention shown in FIGS. 1–5.
Figure 6A:
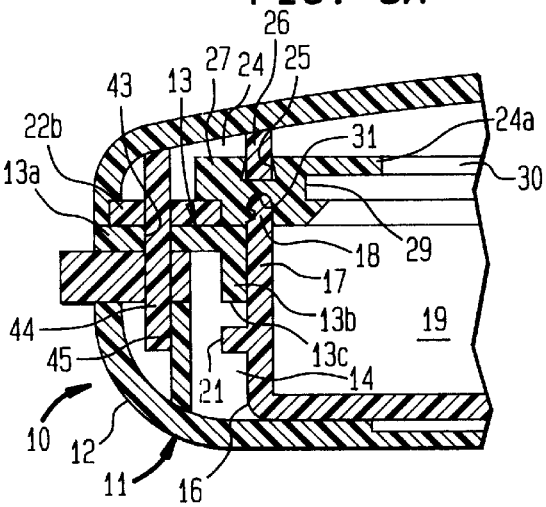
FIG. 6A is an enlarged fragmentary view of the latch end of the compact shown in FIG. 6.
Figure 6B:
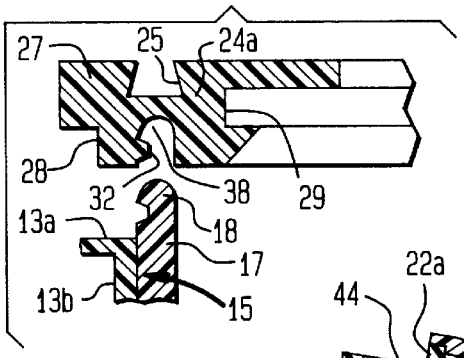
FIG. 6B is an enlarged fragmentary view of the sealing means on the sealing assembly shown in FIGS. 6 and 6A.
Figure 7:
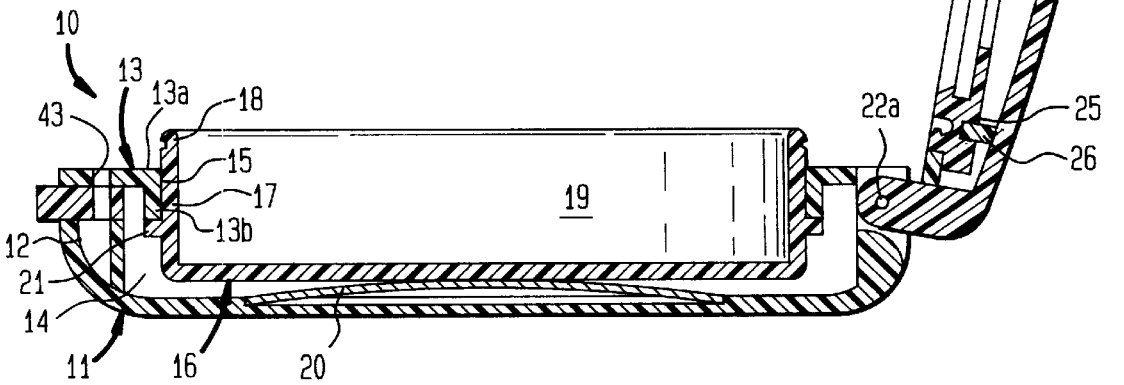
FIG. 7 is the same cross-section shown in FIG. 6 with the cover in the open position.

A biasing spring 20 is mounted in the compartment 14 and is so shaped and formed that it will engage the outer bottom surface of the tray member 16 and at all times will continually urge the tray member 16 in an upward direction. A suitable annular stop means as at 21 provided on the outer or exterior surface of the tray member 16 will engage the lower face or surface 13*c* on the vertical section 13*b* on bezel 13 during vertical upward movement of the tray member 16 so as to limit such vertical movement, all of which is shown in FIGS. 5, 6 and 7 of the drawings.

While one type of biasing spring is illustrated, those skilled in the art will readily recognize that any of a number of conventional spring members may be used for this purpose without departing from the scope of the present invention.

Referring further to FIGS. 1 to 7 of the drawings, a cover 22 having an inner surface 23 is pivotably connected at one end by any suitable type of hinge means 22*a* to the base 11 to enable the cover 22 to be manually pivoted from an open position to a closed position overlying the storage compartment 19 formed by the tray member 16 and vice versa.

In order to establish the hermetic seal in the compact 10 for keeping the cosmetics, make-up and the like other materials to be stored in compact 10 in generally airtight conditions, a seal assembly generally designated 24 is provided to form a seal between the cover 22 and the upper surface 18 of the peripheral wall 17 on the tray member 16 when the cover 22 is pivoted to the closed position.

Thus referring to FIGS. 4, 5, 6 and 7, sealing assembly 24 is shown to have a sealing means or resilient gasket 24*a* which has an annular mounting groove 25 on its upper face. Annular mounting groove 25 is undercut in a keystone shape in cross-section to provide means for removably connecting the sealing means or resilient gasket 24*a* for snug and firm engagement on and with an annular mounting ridge 26 extending downwardly from the inner face 23 of the cover 22 so that when the cover 22 is pivoted to the open and closed positions, the sealing means or resilient gasket 24*a* will move therewith as is shown in FIGS. 6 and 7 of the drawings.

FIGS. 4, 5, 6 and 7 further show that the sealing means or resilient gasket 24*a* has a shaped annular section 27 about the perimeter which is undercut at its outer annulus as at 28 to engage and fit against the inner face 28*a* of an opening formed in a second or upper bezel 22*b* on the cover 22. Sealing means or resilient gasket 24*a* is also undercut as at 29 on the inner annulus of the shaped annular section 27 to receive and mount therein a mirror 30 as is conventionally provided in hand held compacts.

One of the most important aspects of the sealing means or resilient gasket 24*a* is that in the lower face opposite from the upper face, an annular sealing groove 31 is formed so that when the cover 22 is moved from the open position to the closed position, shown in FIG. 6, the annular sealing groove 31 will engage and form the hermetic seal with the upper shaped and sized mating annulus or surface 18 of the peripheral wall 17 on the tray member 16.

For this purpose annular sealing groove 31 has a predetermined size and matching shape to that of the mating annulus 18 and an annular inwardly extending lip as at 32 so that the annular sealing groove 31 will detachably engage the predetermined sized and matingly shaped annulus 18 on the peripheral wall 17 of the tray member 16, all of which is shown in FIGS. 4, 5, 6 and 7 of the drawings.

Thus the sealing means or resilient gasket 24*a* is so affixed in assembled position on the cover 22 that when the cover 22 is pivoted to the closed position, sealing means or resilient gasket 24*a* will detachably but firmly engage the annulus or upper surface 18 of the peripheral wall 17 on tray member 16 to establish the desired hermetic and generally airtight seal to preserve and maintain the contents and materials stored in the tray member 16 in fresh and usable condition.

However, because of the biasing spring 20, when the cover is pivoted to the closed position to bring the sealing means 24*a* into detachable but firm engagement with mating annulus or upper face 18 on the peripheral wall 17 to form the hermetic or generally airtight seal as above described, the tray member 16 will move vertically downward against the biasing spring 20. Since the biasing spring 20 is continuously urging the tray member 16 in a vertically upward direction, the compression forces in the biasing spring 20 will increase and create an even greater counterforce against the tray member 16 to aid in maintaining the hermetic or generally airtight seal established between the sealing means or resilient gasket 24*a* and the upper face 18 of the peripheral wall 17 on the tray member 16.

As a further means for both maintaining the hermetic seal so formed by the sealing assembly 24 when the cover is moved to the closed position and to provide means for breaking the hermetic seal thus formed to enable the cover 22 to be pivoted to open position so the user of the compact can access the cosmetics, make-up or the like materials in the tray member 16, a latch assembly generally designated 33 is provided to coact with the cover 22 so that in a first position it will detachably hold the cover 22 in the closed position as shown in FIG. 7 and on movement to a second position will act to engage and break the hermetic seal formed by the sealing assembly 24 to enable the cover to be moved to the open position as show in FIG. 6.

Thus referring now to FIGS. 8 to 13, the latch assembly 33 is shown as having a locking plate 34 with a finger grip member 35. Finger grip member 35 is used for slidably moving the locking plate between said first and second positions as above described when the locking plate is in assembled position on an arcuate locking plate groove 36 formed on a locking assembly support 37 connected to or formed integrally with the inner face of the annular wall 12 serving to define the compartment 14 in base 11. Base 11 has a finger grip cut-out 38 formed in the annular wall 12 which is disposed in communication and on the same general plane as the arcuate locking plate groove 36 so that when the locking plate 34 is in assembled position, the finger grip member 35 will extend through the finger grip cut-out 38 to the exterior of compact 10. The respective left side 39 and right side 40 of the finger grip cut-out 38 in the base 11 will limit the sidewise movement of the finger grip member 35, and this in turn will also limit the sliding movement of the locking plate 34 in the arcuate locking plate groove 36.

When the locking assembly 33 is moved to fasten or lock the cover 22 in assembled position on the base 11, the hermetic or generally airtight seal of the contents or materials in the tray member 16 will occur simultaneously due to the engagement of the sealing assembly 24 with the mating annulus or upper surface 18 on the peripheral wall 17 as above described. Conversely, when the locking assembly 33 is moved to unlock the cover 22 so it can be moved to the open position, the locking assembly 33 will coact with the second or upper bezel 22*a* on the cover 22 to simultaneously break the hermetic or generally airtight seal formed in the compact 10 by the sealing assembly 24.

Thus by further reference to FIGS. 4, 5 and 8–13, the locking plate 34 has a longitudinally extending slot 41 having a keeper 42 formed at one end of the slot. Since the first or lower bezel 13 is annular and overlies the portion of the compartment 14 in which the locking assembly support 37 is mounted, an aligned slot 43 is provided in the bezel 13 to enable latch 44 connected at one end to the cover 22 and depending generally normal to the inner face 22*b* of the cover 22, to extend through the aligned slot 43 into the longitudinally extending slot 41 in the locking plate 34 as the cover is pivoted to the closed position. Latch 44 also has a hook-shaped end as at 45, thus when the cover is pivoted to the closed position, the locking plate 34 can be moved by the finger grip member 35 so that the keeper 42 will engage the hook-shaped end 45 of the latch 44 and lock the cover in the closed position, and as this is occurring, the sealing assembly 34 will simultaneously form the hermetic or generally airtight seal with the mating annulus 18 all as above described.

Locking plate 34 is also provided with upwardly extending protuberances as at 46*a* and 46*b* disposed in predetermined spaced relation on opposite sides of the longitudinally extending slot 41. Disposed in the first or lower bezel 13 in alignment with the upwardly extending protuberances 46*a* and 46*b*, are spaced and sized slots as at 47*a* and 47*b* through which the upwardly extending protuberances extend for engagement with the outer face of the second or upper bezel 22*a* to break the hermetic seal when the locking plate 34 is moved to the second position to release and enable the cover to move from the closed position as shown in FIG. 6 to the open position as shown in FIG. 7.

Thus the upwardly extending protuberances are so positioned that during the use and operation of the compact 10, they will be in a non-engaged or concealed position when the cover of the compact is in the closed position and will be projected upwardly to move the cover to the open position.

Figure 8:
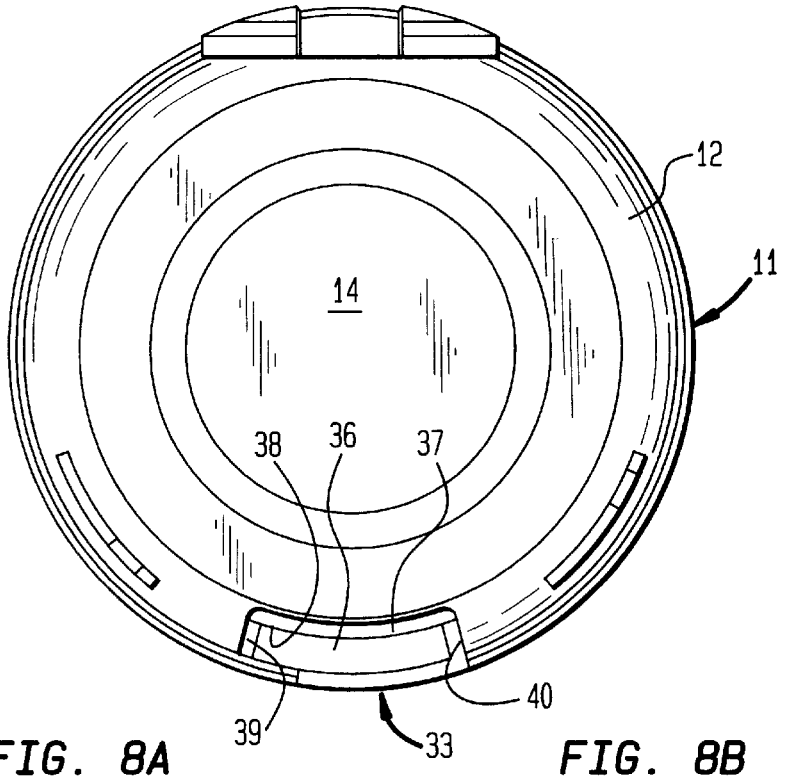
FIG. 8 is a plan view of the base in the form of the invention shown in FIGS. 1–7 with the first or bottom bezel removed.
Figure 9:
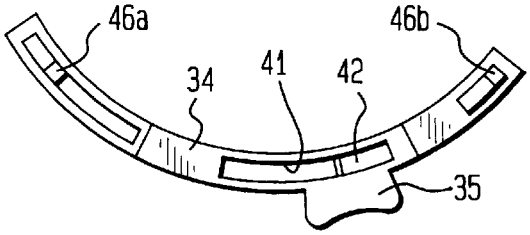
FIG. 9 is an enlarged top plan view of the locking plate for the locking assembly for the form of the invention shown in FIGS. 1–8.
Figure 10:
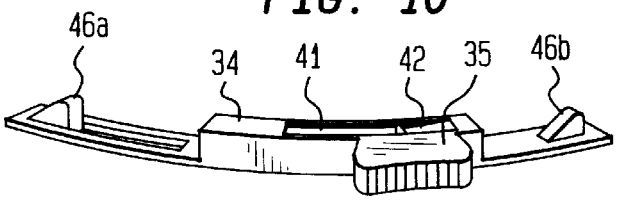
FIG. 10 is a front tilted perspective view of the locking plate shown in FIG. 9.
Figure 12:
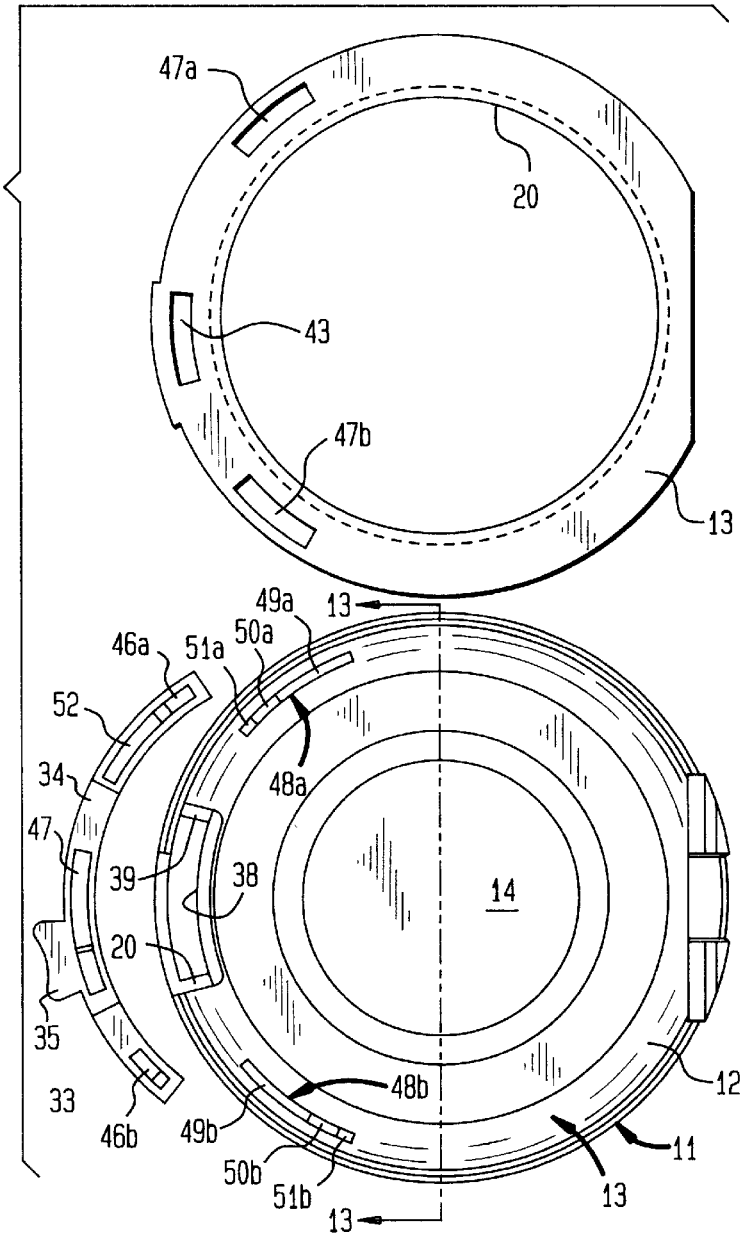
FIG. 12 is an exploded plan view of the base for the form of the invention shown in FIGS. 1–11 showing the latch assembly.
Figure 11:
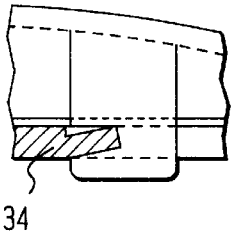
FIG. 11 is a front view of the latch on the cover of the compact in the form of the invention shown in FIGS. 1–9 engaged with the keeper on the locking plate of the locking assembly for the said compact.
Figure 12A:
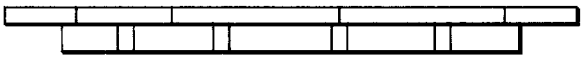
FIG. 12A is a side elevation of the first or lower bezel shown in FIG. 12.
Figure 12B:
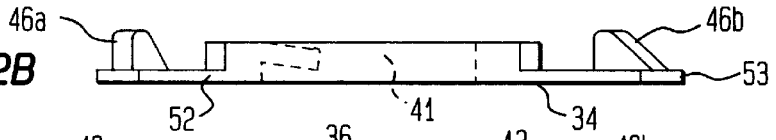
FIG. 12B is a side view partly in vertical section of the locking plate shown in FIG. 12.
Figure 13:
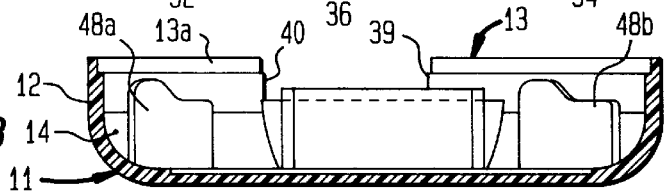
FIG. 13 is an exploded cross-section taken on line 12—12 of FIG. 4.

In order to enable the upwardly extending protuberances 46*a* and 46*b* to move upwardly for engagement with the outer face of the second or upper bezel 22*a* as the locking plate 34 slides to the second position and releases the hook-shaped end 45 for the latch 44, the locking plate 34 is raised in an upward direction by coaction with predetermined spaced and shaped caming members as at 48*a* and 48*b* which are connected or formed on the inner surface of annular wall 12 of the base 11 on opposite sides of the locking assembly support 37 in general alignment with the locking plate groove 36, all of which is shown in FIGS. 8, 9 and 12 of the drawings.

Figure 8A:
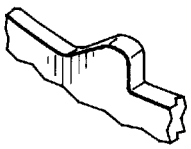
FIG. 8A and FIG. 8B are fragmentary views, respectively, of the caming members shown in the base for the compact as shown in FIG. 8.
Figure 8B:
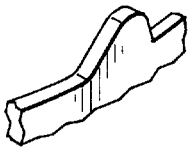

FIGS. 8A and 8B show that the caming members 48*a* and 48*b* are identical in construction and respectively include a caming base as at 49*a* and 49*b* for affixing to or forming the caming members 48*a* and 48*b* with the inner surface of the annular wall 12 so that planar sections as at 50*a* and 50*b* on the respective caming members are in alignment and on the same plane with the locking plate groove 36 in the locking assembly support 37. Continuous with the planar sections 50*a* and 50*b* each of the caming members 48*a* and 48*b* has a caming surface as at 51*a* and 51*b* which has a predetermined upwardly extending slope which rises as a function of the amount the locking plate 34 of the locking assembly 33 needs to be lifted or raised in order for the upwardly extending protuberances 46*a* and 46*b* can meet and engage the second or upper bezel 22*a* to break the hermetic or generally airtight seal formed by the sealing assembly when the cover 22 is moved to the closed position.

When the locking plate 34 is in its closed position, it rests on the raised platforms 34 of the base 11. In this position, the first caming slope 48*a* protrudes through a slotted opening 52 in front of the first upwardly extending protuberance 46*a* on the latch means, and the second caming slope 48*b* is adjacent to the opposite end 53 of the locking plate 34.

It has been found that when the slope of the caming surfaces 51*a* and 51*b* are at an approximate angle of 27° and the size of the upwardly projecting protuberances 46*a* and 46*b* are approximately one-half inch that the movement of the locking plate 34 from the closed to the open position will be sufficient to break the hermetic seal formed in the compact by the sealing assembly 24 as above described.

The caming surfaces 51*a* and 51*b*, however, can be in a range from 20° to 40° and the upwardly extending protuberance from three-eighths of an inch to three-quarters of an inch to achieve the same result.

In the use and operation of compact 10, the finger grip member 35 of the latch assembly 33 moves the locking plate 24 to release the latch 43 on the cover 22 and to slide the locking plate 34 so that the upwardly extending protrusions 46*a* and 46*b* will engage the adjacent face of the second or upper bezel 22*a* to break the hermetic seal formed in the compact 10, all as above described so that the cover 22 can be moved to the open position. The tray member 16 is then filled with the desired cosmetics, make-up or other like pastes, powders or granular materials for which the compact 10 will be used. The cover 22 is then pivoted to the closed position. As the cover 22 is moved to its closed position, the outer surface of the second or upper bezel 22*a* engages the upwardly extending protrusions 46*a* and 46*b* on the locking plate 35 and forces the locking plate 35 to slide off the caming surfaces 51*a* and 51*b* of the caming members 48*a* and 48*b* so the finger grip member 35 can then move the keeper 42 on the locking plate into engagement with the hook-shaped end 45 of the latch 43 on the cover 22 to lock the cover 22 in the closed position. The bottom surface of the locking plate slides downwardly on the caming slopes 50*a* and 50*b*, moving the keeper 42 on the locking plate 34 horizontally to engage the hook-shaped latch 44. The sealing means 24*a* of the sealing assembly 24 engages the upper end 18 of the peripheral wall 17 and presses tray 17 downwardly onto the biasing spring 20 so that the spring 20 is further compressed to exert additional forces to urge the tray 17 upwardly. This upper or the top surface 18 of the peripheral wall 17 forms the desired hermetic or generally airtight seal.

To open the compact, the finger-grip portion 35 of the locking plate 34 is used to slide the locking plate to its open position. The bottom surface of the locking plate contacts the caming slopes 51*a* and 51*b* on the caning means 48*a* and 48*b*, moving the upwardly extending protrusions 46*a* and 46*b* on the locking plate upwardly to contact the inner surface of the second or upper bezel 22*a*. This moves the cover upwardly and breaks the hermetic seal. The cover may then be moved to its open position. As the cover is moved to its open position, the biasing spring 20 continues to urge the tray 17 upwardly until the annular stop 21 engages the lower face 13*c* of the first or lower bezel 13.

While the foregoing description of the illustrated figures of the drawings illustrates one of the preferred embodiments in accordance with the present invention, those skilled in the art will appreciate that numerous modifications can be made to various aspects of the present improved compacts described. Indeed, without departing from the scope of the present invention, the foregoing description of the preferred embodiment should be taken by way of illustration rather than by way of limitation with respect to the present invention which is defined by the claims set forth below.

What is claimed is:

1. A compact for holding and retaining spoilable cosmetics, and paste, powder and granular make-up materials under generally airtight conditions when the compact is in a closed position comprising:

a) base means having a compartment;

b) tray means for said spoilable cosmetics and make-up materials mounted for limited sliding movement in the compartment in said base means, c) said tray means having an upper peripheral surface;

d) a cover having an inner surface pivotably connected to the base means for movement from an open position to the closed position overlying said tray means;

e) an annular mounting ridge extending downwardly from said inner surface of said cover;

f) a seal assembly connected to the cover including seal means having an upper surface and an annular mounting groove in said upper surface of the seal means, said annular mounting ridge engaging said annular mounting groove;

g) the seal means and the upper peripheral surface of the tray means being operatively sized and shaped for mating and releasably interlocking engagement in said closed position;

h) biasing means disposed in the compartment in the base for operative engagement with the tray means to urge the tray means upwardly to bring the upper peripheral surface on the tray into operative sealing engagement with the seal means when the cover is moved to the closed position; and i) latch means between the cover and the base to releasably maintain the cover in the closed position.

2. A compact for holding and maintaining spoilable cosmetics and paste, powder and granular make-up materials under generally airtight conditions when the compact is in a closed position, comprising:

a) a base having a bezel at its upper end with an opening therethrough defining a compartment in the base;

b) tray means for said spoilable cosmetics and make-up materials having a peripheral wall with an upper face, said tray means mounted for sliding movement in the compartment through the opening in the bezel;

c) a cover having an inner surface pivotably connected to the base to move from an open position to the closed position overlying the tray means;

d) an annular mounting ridge extending downwardly from said inner surface of said cover;

e) seal means connected to the cover, said seal means having an upper surface and an annular mounting groove in said upper surface of the seal means, said annular mounting ridge engaging said annular mounting groove;

f) the seal means and the upper face of the peripheral wall being operatively sized and shaped for mating and releasably interlocking engagement in said closed position;

g) resilient means disposed in the compartment in the base for operative engagement with the tray means to urge the tray means upwardly when the cover is moved to the closed position to maintain the spoilable cosmetics and make-up materials in the tray means under airtight conditions; and h) a latch assembly for maintaining the cover in the closed position, and operative to release the seal means and enable the cover to be pivoted to open position.

3. The compact as in claim 2 wherein:

a) the cover has a latch means; and b) the latch assembly includes, a locking plate member movably mounted in the base for operative engagement with the latch means on the cover to maintain the cover in the closed position and to release the cover and the seal means to enable the cover to be pivoted to open position.

4. The compact as in claim 2 wherein said peripheral wall on the tray means has an exterior surface, and an annular flange is connected about the exterior surface of said peripheral wall for coaction with said bezel to limit vertical movement of the tray when the cover is moved to the open position.

5. The compact as in claim 4 wherein:

a) the bezel on the base has an annular horizontal section with an inner annulus, and a vertical section connected to the inner annulus of said horizontal section extending downwardly into said compartment to form the stop means; and b) said annular flange formed on the exterior surface of the peripheral wall is disposed for engagement with the stop means to limit the upward vertical movement of the tray means when the cover is moved to the open position.

6. A compact for maintaining cosmetics and paste, powder and granular make-up materials under generally airtight conditions, comprising:

a) a base having a bezel at its upper end with an opening therethrough defining a compartment in the base;

b) tray means for the said cosmetics and make-up materials mounted in the compartment for sliding movement through the opening in the bezel;

c) said tray means having a peripheral wall with a top surface;

d) a cover having an inner surface pivotably connected to the base to move from an open to a closed position overlying the tray means;

e) seal means between the inner surface of the cover and the top surface of the peripheral wall of the tray means to hermetically seal the said cosmetics and make-up materials in the tray means when the cover is pivoted to the closed position;

f) a biasing spring disposed in the compartment in the base for operative engagement with the tray means to urge the tray means upwardly when the cover is moved to the closed position to maintain the said cosmetics and make-up materials under airtight conditions;

g) a latch assembly for maintaining the cover in the closed position operative to release the seal means to enable the cover to be pivoted to open position;

h) the latch assembly includes, a locking plate slidably mounted in the base having a keeper formed therein and upwardly extending protrusions;

i) the cover includes, a latch member disposed to engage said keeper when the cover is moved to the closed position; and j) the base including camming means operative to coact with the upwardly extending protrusions to break the hermetic seal and release the cover when the cover is moved to the open position.

7. The compact of claim 6 wherein the camming means define camming surfaces, and said camming surfaces at an angle to the base in a range from 20° to 40°.

8. The compact of claim 6 wherein the camming means define camming surfaces, and said camming surfaces are preferably at an angle of 27°.

9. A compact for holding and maintaining spoilable cosmetics and paste, powder and granular make-up materials under generally airtight conditions when the compact is in a closed position, comprising:

a) a base having a bezel at its upper end with an opening therethrough defining a compartment in the base;

b) tray means for said cosmetics, make-up and the like paste, powder and granular materials having a peripheral wall having an upper face and an exterior, said tray means mounted for sliding movement in the compartment through the opening in the bezel;

c) a cover having an inner surface pivotably connected to the base to move from an open position to the closed position overlying the tray means;

d) seal means between the inner surface of the cover and the upper face of the peripheral wall of the tray means to hermetically seal the cosmetics, make-up and the like paste, powder and granular materials in the tray means when the cover is pivoted to the closed position;

e) resilient means disposed in the compartment in the base for operative engagement with the tray means to urge the tray means upwardly when the cover is moved to the closed position to maintain the cosmetics, make-up and the like paste, powder and granular materials under airtight conditions; and f) a latch assembly for maintaining the cover in the closed position and operative to release the seal means and enable the cover to be pivoted to open position, said latch assembly including a locking plate slidably mounted in the base having a keeper formed therein and upwardly extending protuberances;

g) the cover has a latch member disposed to engage said keeper when the cover is moved to the closed position; and h) camming means on the base operative to coact with the upwardly extending protuberances to break the hermetic seal and release the cover when the latch assembly is moved to the open position.

10. A compact for holding and maintaining spoilable cosmetics and paste, powder and granular make-up materials under generally airtight conditions when the compact is in a closed position, comprising:

a) a base having a bezel at its upper end with an opening therethrough defining a compartment in the base;

b) tray means for said spoilable cosmetics and make-up materials having a peripheral wall with a sized and shaped upper face mounted for sliding movement in the compartment through the opening in the bezel;

c) a cover having an inner surface pivotably connected to the base to move from an open position to the closed position overlying the tray means;

d) seal means connected to the inner surface of the cover including a sized and shaped groove means operative to engage the upper face of the peripheral wall of the tray means to hermetically seal said spoilable cosmetics and make-up materials in the tray means when the cover is pivoted to the closed position;

e) resilient means disposed in the compartment in the base for operative engagement with the tray means to urge the tray means upwardly when the cover is moved to the closed position to maintain the spoilable cosmetics and make-up materials under airtight conditions;

f) a latch assembly for maintaining the cover in the closed position, operative to release the seal means and enable the cover to be pivoted to open position, said latch assembly including a locking plate slidably mounted in the base having a keeper formed therein and upwardly extending protuberances;

g) the cover has a latch member disposed to engage said keeper when the cover is moved to the closed position; and h) camming means on the base operative to coact with the upwardly extending protuberances to break the hermetic seal and release the cover when the latch assembly is moved to the open position.

11. A compact for holding and maintaining spoilable cosmetics and paste, powder and granular make-up materials under generally airtight conditions when the compact is in a closed position, comprising:

a) a base having a bezel at its upper end with an opening therethrough defining a compartment in the base;

b) tray means for said spoilable cosmetics and make-up materials having a peripheral wall having an upper face and an exterior, said tray means mounted for sliding movement in the compartment through the opening in the bezel;

c) a cover having an inner surface pivotably connected to the base to move from an open position to the closed position overlying the tray means;

d) seal means between the inner surface of the cover and the upper face of the peripheral wall of the tray means to hermetically seal said spoilable cosmetics and make-up materials in the tray means when the cover is pivoted to the closed position;

e) resilient means disposed in the compartment in the base for operative engagement with the tray means to urge the tray means upwardly when the cover is moved to the closed position to maintain the said spoilable cosmetics and make-up materials under airtight conditions; and f) a latch assembly for maintaining the cover in the closed position and operative to release the seal means and enable the cover to be pivoted to open position, said latch assembly including locking plate means;

g) a locking assembly support mounted in said base having a locking plate groove;

h) said locking plate means slidably mounted in said locking plate groove for movement from a first position for locking said cover in the closed position and to a second position for enabling the cover to move to the open position;

i) means on said locking plate means operative to engage the surface face of the cover to break the hermetic seal when said locking plate is moved to enable the cover to move to the open position;

j) spaced camming means support connected in the base respectively on opposite sides of the locking assembly support; and k) camming surfaces on said spaced camming means disposed for operative engagement with the means on the locking plate for breaking the hermetic seal.

12. The compact as in claim 11 wherein the camming surfaces are at an angle in a range from 20° to 40°.

13. The compact as in claim 11 wherein the camming surfaces are preferably at an angle of 27°.

14. A compact for holding and maintaining spoilable cosmetics and paste, powder and granular make-up materials under generally airtight conditions when the compact is in a closed position, comprising:

a) a base having a bezel at its upper end with an opening therethrough defining a compartment in the base;

b) tray means for said spoilable cosmetics and make-up materials having a peripheral wall with a sized and shaped upper face mounted for sliding movement in the compartment through the opening in the bezel;

c) a cover having an inner surface pivotably connected to the base to move from an open position to the closed position overlying the tray means;

d) seal means connected to the inner surface of the cover including, a sized and shaped groove means operative to engage the upper face of the peripheral wall of the tray means to hermetically seal the said spoilable cosmetics and make-up materials in the tray means when the cover is pivoted to the closed position;

e) resilient means disposed in the compartment in the base for operative engagement with the tray means to urge the tray means upwardly when the cover is moved to the closed position to maintain the said spoilable cosmetics and make-up materials under airtight conditions; and f) a latch assembly for maintaining the cover in the closed position, operative to release the seal means and enable the cover to be pivoted to open position, said latch assembly including locking plate means;

g) a locking assembly support mounted in said base having a locking plate groove;

h) said locking plate means slidably mounted in said locking plate groove for movement from a first position for locking said cover in the closed position and to a second position for enabling the cover to move to the open position;

i) means on said locking plate means operative to engage the inner surface of the cover to break the hermetic seal when said locking plate is moved to enable the cover to move to the open position;

j) spaced camming means support connected in the base respectively on opposite sides of the locking assembly support; and k) camming surfaces on said spaced camming means disposed for operative engagement with the means on the locking plate for breaking the hermetic seal.

15. The compact as in claim 14 wherein the camming surfaces are at an angle in a range from 20° to 40°.

16. The compact as in claim 14 wherein the camming surfaces are preferably at an angle of 27°.

17. A compact having a cover and a latch assembly, said latch assembly comprising;

a) a locking plate including means on said locking plate forming spaced upwardly extending protrusions;

b) camming means in said compact disposed for operative engagement with said upwardly extending protrusions whereby on movement of said locking plate from a first position to a second position the upwardly extending protrusions are brought into engagement with the cover to enable it to move to an open position;

c) a locking plate support mounted in said compact having, a locking plate groove; and d) said locking plate slidably mounted in said locking plate groove and moveable along a plane from a first position for locking said cover in a closed position to a second position for enabling said cover to move to an open position.

18. In the latch assembly as in claim 17 wherein:

a) said camming means includes, camming slopes disposed at an angle to the plane of movement of the locking plate; and b) said camming slopes have an angle in a range from 20° to 40°.

19. In the latch assembly as in claim 17 wherein:

a) said camming means includes, camming slopes disposed at an angle to the plane of movement of the locking plate; and b) said camming slopes are preferably at an angle of about 27°.

* * * * *

UNITED STATES PATENT AND TRADEMARK OFFICE
CERTIFICATE OF CORRECTION

PATENT NO. : 5,908,037

DATED : June 1, 1999

INVENTOR(S) : Pierson

It is certified that error appears in the above-identified patent and that said Letters Patent is hereby corrected as shown below:

Throughout the Abstract and the Specification, "caming" should read --camming.

In the Abstract, line 10, delete "is".

Column 3, line 59, after "to" (second occurrence) insert --the--.

Column 4, line 55, delete "show".

Column 4, line 56, after "10" insert --is shown--.

Column 5, line 1, after "and" insert --,--.

Column 5, line 2, after "12" insert --,--.

Column 5, line 15, after "in" insert --the--.

Column 8, line 10, "can" should read --to--.

Column 8, line 59, delete "the". (first occurrence).

Column 8, line 64, "caning" should read --camming--.

Column 11, line 12, after "surfaces" insert --are--. (second occurrence).

Signed and Sealed this

Seventh Day of December, 1999

*Attest:*

Q. TODD DICKINSON

*Attesting Officer*

*Acting Commissioner of Patents and Trademarks*